US005391104A

United States Patent [19]

George

[11] Patent Number: 5,391,104

[45] Date of Patent: Feb. 21, 1995

[54] SUSPENDED BUNGEE CORD DOLL

[76] Inventor: Kenneth S. George, 502 6th St., Ogden, Utah 84404

[21] Appl. No.: 137,405

[22] Filed: Oct. 18, 1993

[51] Int. Cl.[6] ..... A63H 3/00; A63H 3/20

[52] U.S. Cl. ..... 446/177; 446/268; 446/361; 446/315; 446/384

[58] Field of Search ..... 446/177, 228, 268, 361, 446/362, 491, 308, 309, 311, 315, 490, 323, 384; 119/770, 798; 224/224; 40/597; D20/42, 14

[56] References Cited

U.S. PATENT DOCUMENTS

| | | | |
|---|---|---|---|
| D. 162,796 | 4/1951 | Dorn | 446/361 |
| D. 317,944 | 7/1991 | George | 40/597 |
| 1,038,057 | 9/1912 | Younger | 446/323 |
| 1,287,328 | 12/1918 | Jafferian | 446/361 |
| 2,484,343 | 10/1949 | Hawes | 446/177 |
| 2,596,884 | 5/1952 | Bailen | 224/224 |
| 3,706,155 | 12/1972 | Balza | 446/384 |
| 3,977,122 | 8/1976 | Meyer et al. | 446/268 |
| 4,373,292 | 2/1983 | Pelura | 446/268 |
| 4,751,896 | 6/1988 | Miley | 119/770 |
| 5,125,864 | 6/1992 | Roberson et al. | 446/268 |
| 5,267,887 | 12/1993 | Licata et al. | 446/309 |

FOREIGN PATENT DOCUMENTS

| | | | |
|---|---|---|---|
| 19694 | 9/1929 | Australia | 40/597 |
| 286257 | 7/1915 | Germany | 446/362 |

*Primary Examiner*—Robert A. Hafer
*Assistant Examiner*—Jeffrey D. Carlson
*Attorney, Agent, or Firm*—Hugh E. Smith

[57] ABSTRACT

A figurine simulating an invertedly suspended human, i.e. a bungee jumper, for suspended attachment to an automobile rear view mirror or other surface. The doll is provided with an elastic cord coupled to a suction cup and wrapped around the ankles of the figurine. Storage of excess cord is provided within an interior cavity of the figurine and such cord may be dispensed therefrom to change the suspended height of the doll. Alternate embodiments of the present invention include both a retracting assembly disposed within the interior cavity for retracting the excess cord through a rotation of the head of the figurine, and a label assembly coupled to the figurine for receiving and displaying cards having custom indicia thereon.

12 Claims, 4 Drawing Sheets

SUSPENDED BUNGEE CORD DOLL

BACKGROUND OF THE INVENTION

1. Field of the Invention

The present invention relates to dolls and more particularly pertains to a figurine simulating a bungee jumper for suspended attachment to an automobile rear view mirror or other surface.

2. Description of the Prior Art

The use of dolls is known in the prior art. More specifically, dolls heretofore devised and utilized for the purpose of simulating physical activities are known to consist basically of familiar, expected and obvious structural configurations, notwithstanding the myriad of designs encompassed by the crowded prior art which have been developed for the fulfillment of countless objectives and requirements.

For example, a toy action figure and speech and sound effect accessory therefore is illustrated in U.S. Pat. No. 5,073,140 which includes toy action figures and detachable accessories that incorporate audio generating apparatus. The audio generating apparatus is entirely contained within the accessory and generates both speed and sound effects. The detachable accessories have a configuration and visual appearance coordinated with the configuration and visual appearance of the toy action figure. The accessories in configuration, appearance, and sound content are made to be attachable and applicable to different types of action figures.

Another patent of interest is U.S. Pat. No. 4,964,831 which discloses a collector edition doll including an outer casing having a painted face depicting an event or events in the life of the doll. A pedestal for the casing is also provided and the doll, casing, and pedestal are all hand crafted from wood and hand painted so that each is unique in its own right. In addition, each doll comes with a story sheet which details events in the life of the doll and, in particular, that event depicted on the face of the casing.

Other relevant patents include U.S. Pat. Nos. Des. 283,906, U.S. Pat. No. Des. 283,520, and U.S. Pat. No. 3,611,627.

While these devices fulfill their respective, particular objectives and requirements, the aforementioned patents do not disclose a figurine simulating a bungee jumper for suspended attachment to an automobile rear view mirror other surface which is provided with an elastic cord wrapped around the ankles of the figurine and coupled to a suction cup whereby excess cord may be stored within an interior cavity of the figurine. Furthermore, none of the known prior art dolls teach or suggest both a retracting assembly disposed within the interior cavity for retracting the excess cord through a rotation of the head of the figurine, and a label assembly coupled to the figurine for receiving and displaying cards having custom indicia thereon.

In these respects, the suspended bungee cord doll according to the present invention substantially departs from the conventional concepts and designs of the prior art, and in so doing provides an apparatus primarily developed for the purpose of providing a figurine simulating a bungee jumper for suspended attachment to a surface.

SUMMARY OF THE INVENTION

In view of the foregoing disadvantages inherent in the known types of dolls now present in the prior art, the present invention provides a new suspended bungee cord doll construction wherein the same can be utilized for simulating a bungee jumper through the suspended attachment of a figurine to an automobile rear view mirror or other surface. As such, the general purpose of the present invention, which will be described subsequently in greater detail, is to provide a new suspended bungee cord doll apparatus which has many of the advantages of the dolls mentioned heretofore and many novel features that result in a suspended bungee cord doll which is not anticipated, rendered obvious, suggested, or even implied by any of the prior art dolls, either alone or in any combination thereof.

To attain this, the present invention essentially comprises a figurine simulating an invertedly suspended human, i.e. a bungee jumper, for suspended attachment to an automobile rear view mirror or other surface. The doll is provided with an elastic cord coupled to a suction cup and wrapped around the ankles of the figurine. Storage of excess cord is provided within an interior cavity of the figurine and such cord may be dispensed therefrom to change the suspended height of the doll. Alternate embodiments of the present invention include both a retracting assembly disposed within the interior cavity for retracting the excess cord through a rotation of the head of the figurine, and a label assembly coupled to the figurine for receiving and displaying cards having custom indicia thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new suspended bungee cord doll apparatus which has many of the advantages of the dolls mentioned heretofore and many novel features that result in a suspended bungee cord doll which is not anticipated, rendered obvious, suggested, or even implied by any of the prior art dolls, either alone or in any combination thereof.

It is another object of the present invention to provide a new suspended bungee cord doll which may be easily and efficiently manufactured and marketed.

It is a further object of the present invention to provide a new suspended bungee cord doll which is of a durable and reliable construction.

An even further object of the present invention is to provide a new suspended bungee cord doll which is susceptible of a low cost of manufacture with regard to both materials and labor, and which accordingly is then susceptible of low prices of sale to the consuming public, thereby making such suspended bungee cord dolls economically available to the buying public.

Still yet another object of the present invention is to provide a new suspended bungee cord doll which provides in the apparatuses and methods of the prior art some of the advantages thereof, while simultaneously overcoming some of the disadvantages normally associated therewith.

Still another object of the present invention is to provide a new suspended bungee cord doll in which a figurine simulating a bungee jumper is arranged for suspended attachment to an automobile rear view mirror or other surface.

Yet another object of the present invention is to provide a new suspended bungee cord doll in which a figurine is provided with an elastic cord wrapped around the ankles of the figurine and coupled to a suction cup whereby storage of excess cord is provided within an interior cavity of the figurine.

Even still another object of the present invention is to provide a new suspended bungee cord doll which includes a retracting assembly disposed within the interior cavity of the figurine for retracting the excess cord through a rotation of the head of the figurine.

Even still yet another object of the present invention is to provide a new suspended bungee cord doll which further includes a label assembly coupled to the figurine for receiving and displaying cards having custom indicia thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figures 1, 2:
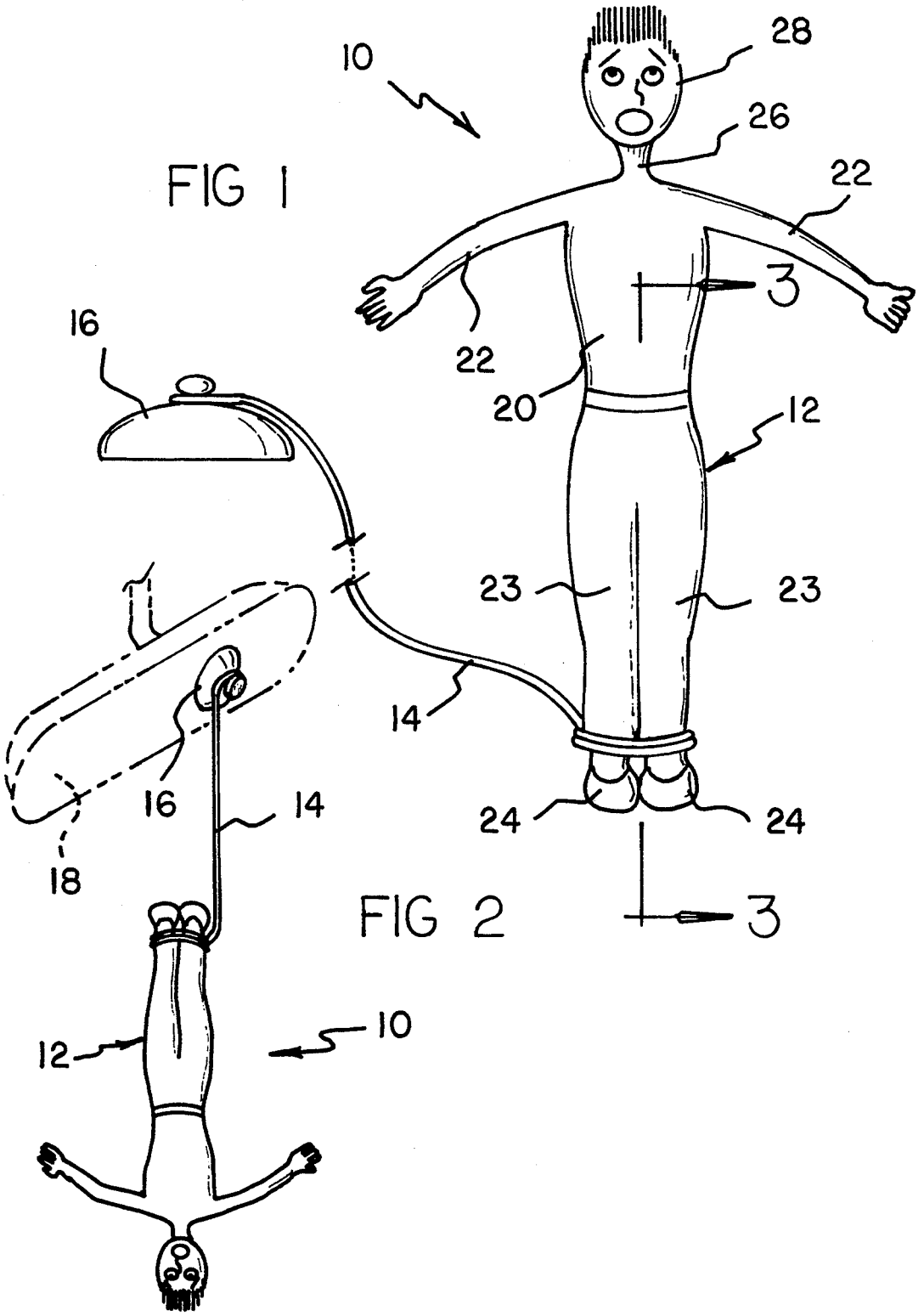
FIG. 1 is a front elevation view of a first embodiment of a suspended bungee cord doll comprising the present invention.
FIG. 2 is a perspective view of the present invention as suspended from a rear view mirror.

With reference now to the drawings, and in particular to FIGS. 1–4 thereof, a first embodiment of a new suspended bungee cord doll embodying the principles and concepts of the present invention and generally designated by the reference numeral 10 will be described.

The suspended bungee cord doll 10 comprises a figurine 12 coupled to a resilient cord 14. A suction cup 16 is coupled to a distal end of the resilient cord 14 and may be secured to any surface or object such as a rear view mirror 18, as best illustrated in FIG. 2. The figurine 12 includes a main body 20 having a pair of arms 22, a pair of legs 23 each terminating at a foot 24, a neck 26, and a head 28 arranged in such a manner so as to define a substantially human-shaped figure.

The suspended bungee cord doll 10 may be attached to any object such as a mirror, a window, a refrigerator door, a ceiling fan, or the like. Because of the elasticity of the resilient cord 14, the suspended bungee cord doll 10 provides a random bouncing and moving of the figurine 12 upon a motion of either the figurine or the attaching suction cup 16. The doll 10 provides an especially unique bouncing motion when attached to the rear view mirror 18, as illustrated in FIG. 2, of a vehicle which imparts random motions and vibrations to the suction cup 16 in a well understood manner.

More specifically, it will be noted that the suspended bungee cord doll 10 comprises a figurine 12 including a main body 20 having connected thereto a pair of arms 22, a pair of legs 23 each terminating at a foot 24, a neck 26, and a head 28 arranged in such a manner so as to define a substantially human-shaped figure. The figurine 12 is comprised of any substantially deformable material which allows the arms 22, as well as the other appendages 23–28 forming a part of the figurine, to be positioned in any desired orientation. Alternatively, the figurine 12 may be constructed of a resilient material which will permit deformation thereof, but which will return to its original shape. The figurine 12 may also include unillustrated wire members extending through the appendages 22–28 such that a deformation of the wire members will result in a new orientation of the figurine.

A resilient cord 14 is wrapped around a lower portion of the legs 23 and extends therefrom to connect with a suction cup 16 that may be removably secured to any conceivable object, such as a rear view mirror 18 of an unillustrated vehicle, as best illustrated in FIG. 2. The resilient cord 14 is comprised of any substantially elastomeric material which allows a length thereof to be resiliently extended. Alternatively, the resilient cord 14 may be a simple length of non-elongatable string or the like. The suction cup 16 attached to a distal end of the resilient cord 14 is of a conventional design and, therefore, will not be described in detail.

Figure 3:
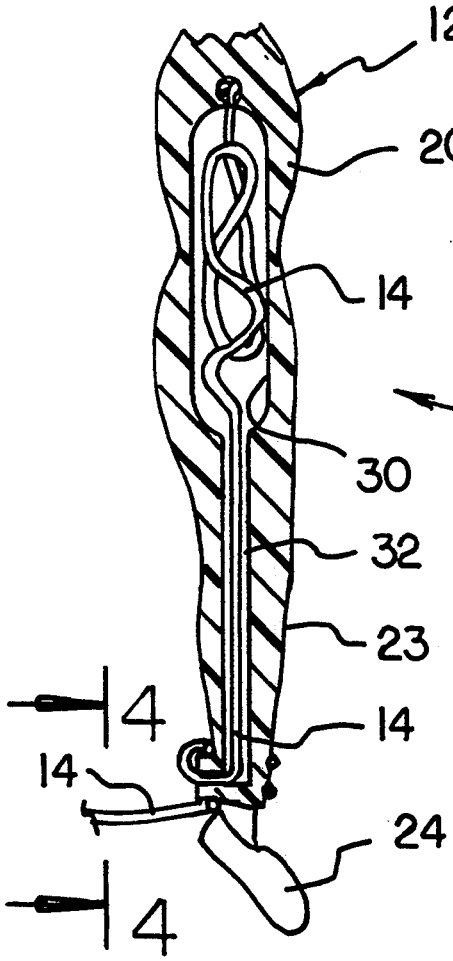
FIG. 3 is a cross sectional view taken along line 3—3 of FIG. 1.
Figure 4:
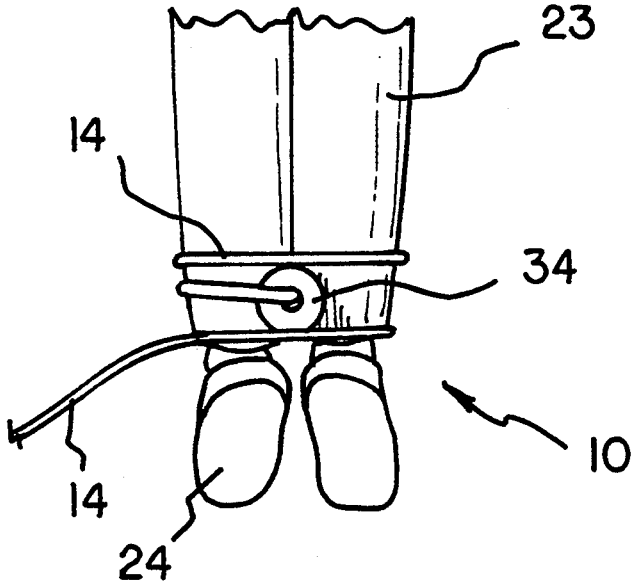
FIG. 4 is a rear elevation view of a portion of the first embodiment as viewed from line 4—4 of FIG. 3.

FIG. 3 illustrates an interior of the figurine 12 and it can be seen from this Figure that the main body 20 includes an interior cavity 30 integrally formed therewithin. In addition, a journal 32 extends through one of the legs 23 to provide communication between the interior cavity 30 and an exterior of the figurine 12, as best illustrated in FIG. 3. The journal 32 terminates just above the feet 24 and includes a grommet 34 through which the resilient cord 14 may enter the journal 32, whereby excess cord may be stored within the interior cavity 30 and retained therein by the frictional engagement between the grommet and the cord. This arrangement allows the suspended bungee cord doll 10 to be provided with an extra amount of the resilient cord 14 within the figurine 12 such that a length of the cord may be adjusted to suspend the figurine at various heights relative to the attached object.

In use, the suspended bungee cord doll 10 may be attached to any object such as a mirror, a window, a refrigerator door, a ceiling fan, or the like. Because of the elasticity of the resilient cord 14, the suspended bungee cord doll 10 provides a random bouncing and moving of the figurine 12 upon a motion of either the figurine or the attaching suction cup 16. The doll 10 provides an especially unique bouncing motion when attached to the rear view mirror 18 of a vehicle which imparts random motions and vibrations to the suction cup 16 in a well understood manner.

Figure 5:
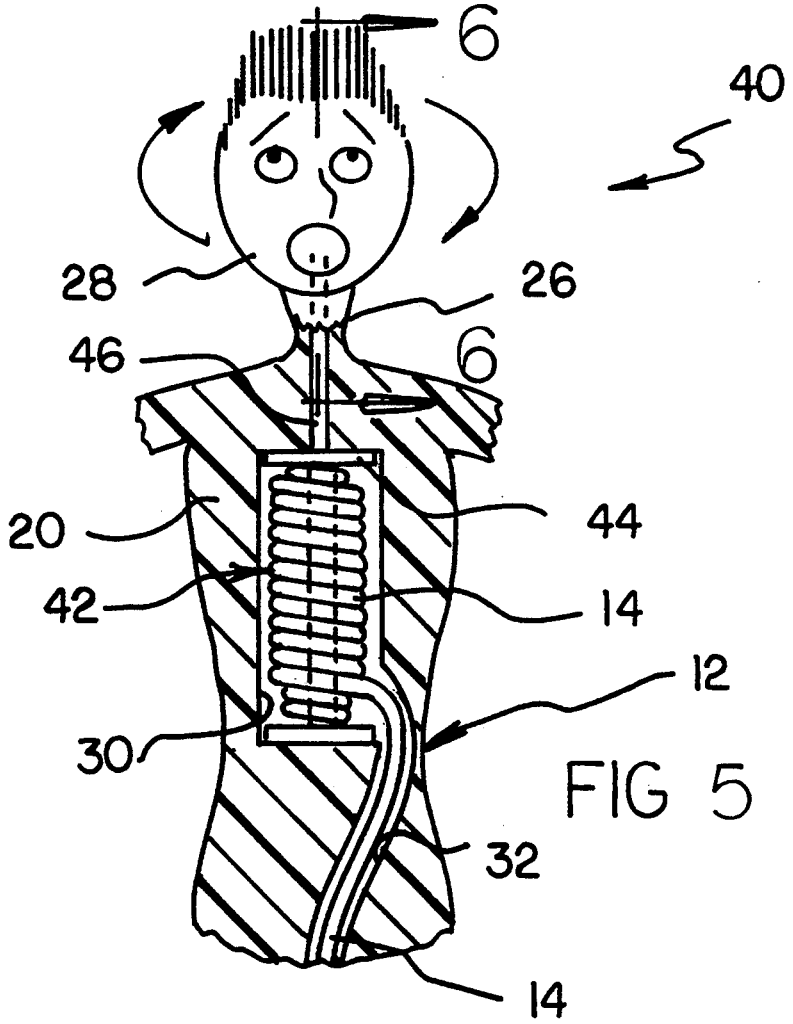
FIG. 5 is a front elevation view, partially in cross section, of a second embodiment of a suspended bungee cord doll comprising the present invention.
Figure 6:
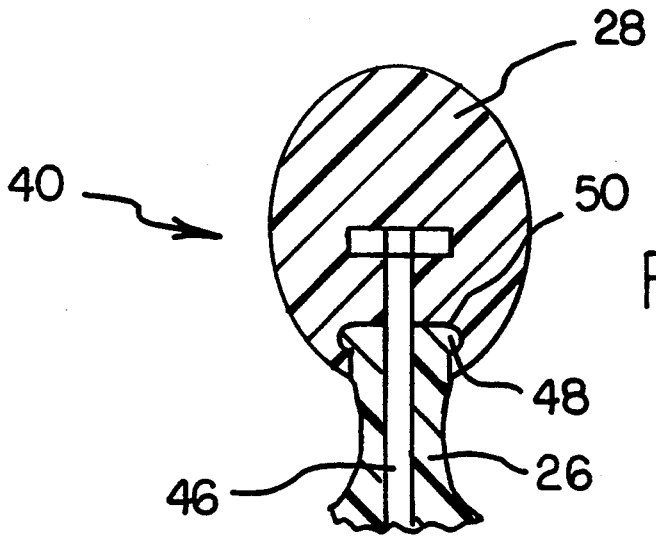
FIG. 6 is a cross sectional view taken along line 6—6 of FIG. 5.

A second embodiment of the present invention as generally designated by the reference numeral 40, which comprises substantially all of the features of the foregoing embodiment 10 and which further comprises a retracting assembly 42 will now be described. As best shown in FIGS. 5–6, it can be shown that the retracting assembly 42 is positioned within the interior cavity 30 of the main body 20 of the figurine 12 and comprises a spool 44 rotatably supported upon an axle 46 which engages respectively opposed ends of the interior cavity 30 to rotatably support the spool therewithin. In addition, the axle 46 passes through an unlabeled aperture in both the main body 20 and the neck 26 where it is fixedly secured to an interior of the head 28. The head 28 is rotatably coupled to the neck 26 such that a rotation of the head 28 will rotate the spool 44 within the interior cavity 30. By this structure, the resilient cord 14 may be selectively retracted or dispensed from within the figurine 12.

FIG. 6 illustrates the rotatable coupling between the head 28 and the neck 26 and it can be seen from this figure that the neck includes an annular projection 48 at a distal end thereof which may snap into and be rotatably captured by an annular groove 50 present within the head 28. Such coupling allows the components of the figurine 12 to be easily manufactured and assembled.

Figure 7:
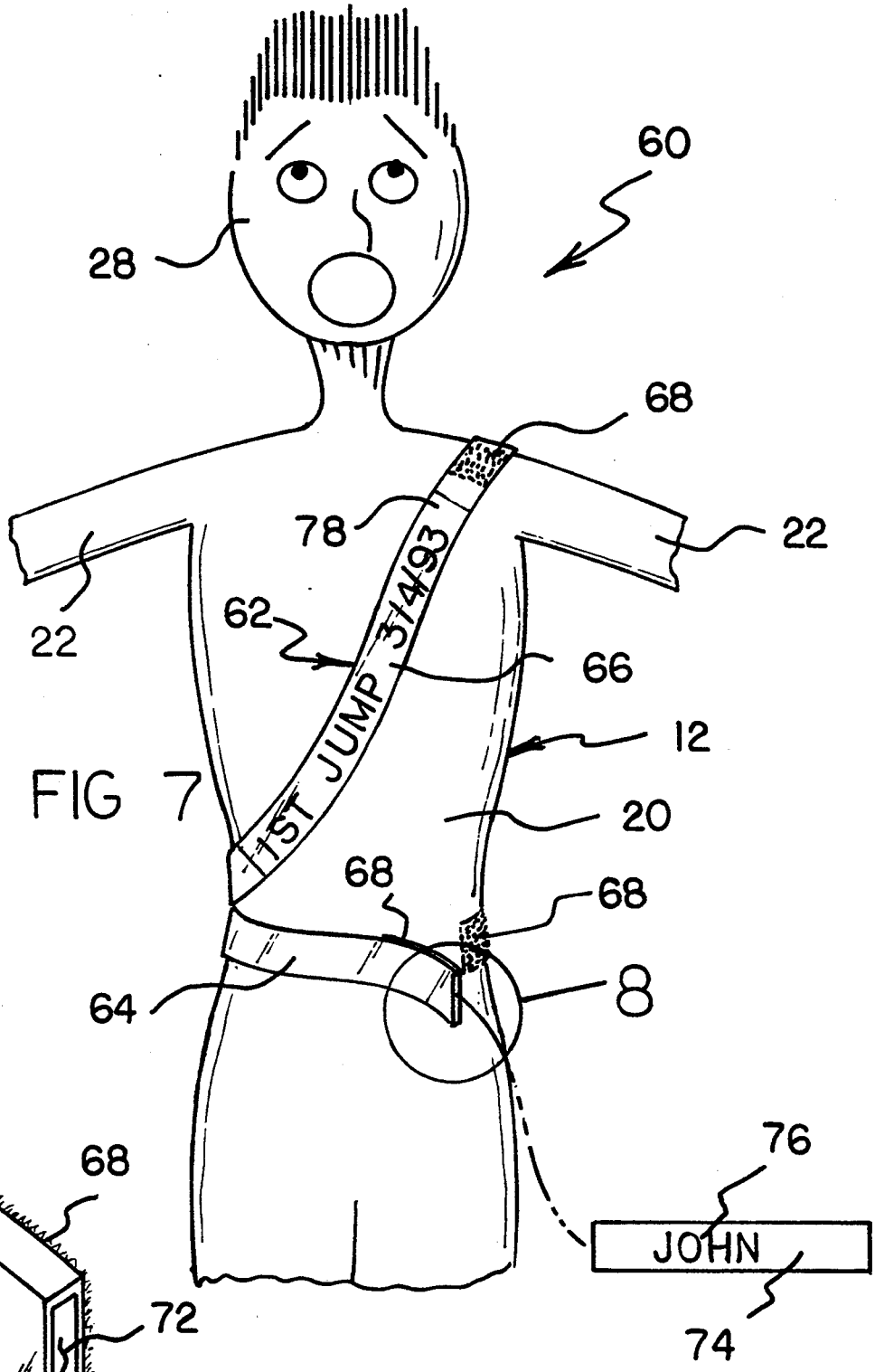
FIG. 7 is an enlarged, perspective view of a portion of a third embodiment of a suspended bungee cord doll comprising the present invention.
Figure 8:
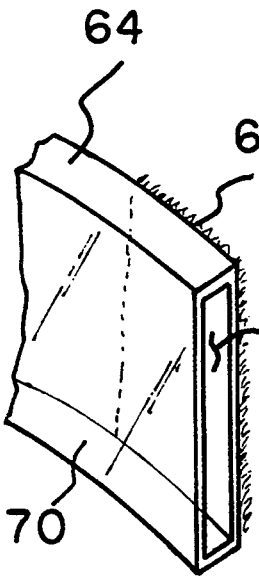
FIG. 8 is an enlarged, perspective view of a portion of the third embodiment as indicated by the circled area of FIG. 7.

Comprising all of the features and structures of the previous embodiments 10, 40 is a third embodiment which generally designated by the reference numeral 60 and may be viewed in FIGS. 7–8. It can be shown that the third embodiment 60 further comprises a label assembly 62 which may be removably secured to the figurine 12. The label assembly 62 is comprised of a waist strap 64 operable to encircle a portion of the main body 20, and a shoulder strap 66 which may be diagonally positioned over the main body. Both the waist strap 64 and the shoulder strap 66 can be secured to the figurine 12 through a well understood use of cooperating fabric fastening material 68 provided both on the straps 64, 66 and the figurine 12. The waist strap 64 and the shoulder strap 66 may be integrally connected together or, alternatively, they may be formed as independent straps.

FIG. 8 illustrates a portion of the waist strap 64 and it can be seen from this figure that the waist strap is formed of a substantially transparent rectangular tubing 70 having a tubing interior 72 into which a card 74 may be positioned. The card 74 may have indicia 76 printed thereon for subsequent display through its positioning within the waist strap 64. Similarly, the shoulder strap 66 is constructed from a rectangular tubing having a tubing interior into which an additional card 78 may be placed for subsequent display thereof. The straps 64, 66 allow customized cards 74, 78 to be displayed upon their placement therewithin, thereby customizing the figurine 12 to a particular user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A suspended doll comprising:

a figurine having a top end and a bottom end;

a cord extending from said bottom end of said figurine; and, an attachment means coupled to said cord for mounting said cord to an object whereby said figurine may be suspended therefrom in an inverted position, such that said top end hangs below said bottom end, wherein said attachment means comprises a suction cup coupled to said cord, wherein said figurine comprises a body defining an interior cavity; and a pair of legs coupled to said body, at .least one of said legs defining a journal therethrough providing communication between said interior cavity and an exterior of said figurine, whereby a portion of said cord can pass through said journal to be removably stored within said interior cavity.

2. The suspended doll of claim 1, and further comprising a retracting means positioned within said interior cavity for selectively retracting and dispensing said cord.

3. The suspended doll of claim 2, wherein said figurine further comprises a neck attached to said body and having an aperture therethrough; and a head rotatably coupled to said neck, and further wherein said retracting means comprises: an axle rotatably mounted within said interior cavity and extending through said aperture in said neck to fixedly engage said head; and a spool supported by said axle and coupled to said cord whereby said cord may be selectively retracted and dispensed through said journal.

4. The suspended doll of claim 1, and further comprising a label means removably coupled to said figurine for receiving and displaying a card.

5. The suspended doll of claim 4, wherein said label means comprises a shoulder strap having a pair of ends and defining a tubing interior into which said card may be received; and a fastening means coupled to said ends for removably coupling said shoulder strap to said figurine.

6. The suspended doll of claim 5, wherein said label means further comprises a waist strap having a pair of ends and defining a tubing interior into which an additional card may be received; and a fastening means coupled to said ends for removably coupling said waist strap to said figurine.

7. The suspended doll of claim 6, wherein said straps are formed of a substantially transparent material.

8. The suspended doll of claim 7, and further comprising a retracting means positioned within said interior cavity for selectively retracting and dispensing said cord.

9. The suspended doll of claim 8, wherein said figurine further comprises a neck attached to said body and having an aperture therethrough; and a head rotatably coupled to said neck, and further wherein said retracting means comprises an axle rotatably mounted within said interior cavity and extending through said aperture in said neck to fixedly engage said head; and a spool supported by said axle and coupled to said cord whereby said cord may be selectively retracted and dispensed through said journal.

10. A suspended doll comprising:

a figurine;

a cord coupled to said figurine;

an attachment means coupled to said cord for coupling said cord to an object whereby said figurine can be suspended therefrom in an inverted position;

wherein said figurine comprises a body defining an interior cavity; and a pair of legs coupled to said body, at least one of said legs defining a journal therethrough providing communication between said interior cavity and an exterior of said figurine, whereby a portion of said cord passes through said journal to be removably stored within said interior cavity;

and further comprising a retracting means positioned within said interior cavity for selectively retracting and dispensing said cord;

wherein said figurine further comprises a neck attached to said body and having an aperture therethrough; and a head rotatably coupled to said neck, and said retracting means comprises an axle rotatably mounted within said interior cavity and extending through said aperture in said neck to fixedly engage said head; and a spool supported by said axle and coupled to said cord whereby said cord may be selectively retracted and dispensed through said journal; and, wherein said attachment means comprises a suction cup.

11. The suspended doll of claim 10, wherein said cord comprises a resiliently deformable elastic cord.

12. A suspended doll comprising:

a figurine;

a cord coupled to said figurine;

an attachment means coupled to said cord for coupling said cord to an object whereby said figurine may be suspended therefrom in an inverted position a label means removably coupled to said figurine for receiving and displaying a card, said label means comprising a shoulder strap having a pair of ends and defining a tubing interior into which said card may be received; and a fastening means coupled to said ends for removably coupling said shoulder strap to said figurine, said label means further comprising a waist strap having a pair of ends and defining a tubing interior into which an additional card may be received; and a fastening means coupled to said ends for removably coupling said waist strap to said figurine;

wherein said straps are formed of a substantially transparent material;

wherein said figurine comprises a body defining an interior cavity; and a pair of legs coupled to said body, at least one of said legs defining a journal therethrough providing communication between said interior cavity and an exterior of said figurine, whereby a portion of said cord passes through said journal to be removably stored within said interior cavity;

and further comprising a retracting means positioned within said interior cavity for selectively retracting and dispensing said cord;

wherein said figurine further comprises a neck attached to said body and having an aperture therethrough; and a head rotatably coupled to said neck, and said retracting means comprises an axle rotatably mounted within said interior cavity and extending through said aperture in said neck to fixedly engage said head; and a spool supported by said axle and coupled to said cord whereby said cord may be selectively retracted and dispensed through said journal; and, wherein said attachment means comprises a suction cup and said cord comprises a substantially resiliently deformable elastic cord.

* * * * *